US005334322A

United States Patent [19]

Williams, Jr.

[11] Patent Number: 5,334,322

[45] Date of Patent: Aug. 2, 1994

[54] WATER DILUTABLE CHAIN BELT LUBRICANT FOR PRESSURIZABLE THERMOPLASTIC CONTAINERS

[75] Inventor: William A. Williams, Jr., Latrobe, Pa.

[73] Assignee: PPG Industries, Inc., Pittsburgh, Pa.

[21] Appl. No.: 954,639

[22] Filed: Sep. 30, 1992

[51] Int. Cl.[5] ..... C10M 105/08; C10M 105/12; C10M 105/14

[52] U.S. Cl. ..... 252/52 A

[58] Field of Search ..... 252/52 A, 49.3, 49.5

[56] References Cited

U.S. PATENT DOCUMENTS

| | | | |
|---|---|---|---|
| 2,425,755 | 7/1947 | Roberts et al. | 260/615 |
| 3,526,596 | 9/1970 | Kress et al. | 252/49.5 |
| 4,496,632 | 1/1985 | Camp et al. | 428/395 |
| 4,521,321 | 6/1985 | Anderson et al. | 252/49.3 |
| 4,929,375 | 5/1990 | Rossio et al. | 252/49.3 |

*Primary Examiner*—Prince Willis, Jr.
*Assistant Examiner*—Cephia D. Toomer
*Attorney, Agent, or Firm*—Donna L. Seidel

[57] ABSTRACT

A method for reducing abrasion of plastic surfaces in moving contact with parts of processing equipment is disclosed involving the use of a novel lubricant which is the reaction product of a short chain alcohol and a short chain oxide, preferably glycerol and a mixture of ethylene oxide and propylene oxide, in aqueous solution.

20 Claims, 1 Drawing Sheet

WATER DILUTABLE CHAIN BELT LUBRICANT FOR PRESSURIZABLE THERMOPLASTIC CONTAINERS

BACKGROUND OF THE INVENTION

The invention relates to thermoplastic containers such as bottles, and more particularly, to the lubrication of chain belts which contact such containers during processing to prevent crazing of such containers.

Blow molded plastic bottles, such as those made from polyethylene terephthalate, have largely replaced heavier glass bottles previously used for carbonated beverages and the like. One disadvantage associated with plastic bottles is the extremely thin wall construction of the body of the bottle. The bottles are inherently weak which prevents them from being returned to the bottler and refilled. One attempt to overcome this disadvantage has been manufacturing plastic bottles of a one-piece construction with thicker body walls which make the bottles stronger, enabling them to be returned to the bottler for refilling. However, such bottles have a serious stress cracking problem, i.e. the development of fine cracks which are the result of the release of stresses introduced into the bottle during the molding process, particularly in the base area of the bottles which is complexly configured so as to both make the bottle free standing and to relieve internal stresses from pressurization. In addition, it has been found that stress introduced into the bottles in the blow molding process is accentuated when the bottles are recycled, because the hot caustic wash, pressurizing the bottles and abrading the base area of the bottles on a conveyor cause hazing or stress cracking on the exterior surfaces of the bottle. If severe enough, the stress cracking can result in loss of pressure and premature rupturing of the bottles.

Copending U.S. application Ser. No. 07/691,660 filed Apr. 26, 1991, commonly assigned, discloses a pressurizable thermoplastic container with a polyurethane layer on its exterior surface. The container can be subjected to multiple hot caustic washings and refillings with carbonated beverages with minimal, if any, stress cracking. Such containers can be prepared by applying, typically by a coating process, a continuous film of a polyurethane over the exterior surface of the thermoplastic container.

However, both coated and uncoated thermoplastic bottles are subject to crazing as a result of contact with chain belts during their conveyance through the various phases of recycling. Chain belt lubricants are sought to minimize this damage.

PRIOR ART

U.S. Pat. No. 4,521,321 to Anderson et al. discloses a lubricant for a conveyor in food or beverage packaging which is an aqueous composition of a partially neutralized phosphate ester of the general formula $R(OCH_2CH_2)_nOP(O)(OH)_2$ where R is a linear alkyl group containing 12 to 20 carbon atoms and n is a number from 0 'to 3.

SUMMARY OF THE INVENTION

The present invention provides a chain belt lubricant which provides good lubricity and prevents crazing of plastic items contacting the chain belt, such as polyethylene terephthalate bottles, and which is particularly suitable for use in the food and beverage industry. The lubricant of the present invention comprises a blend of alkoxylates based on either short chain alcohols, such as butanol, or short chain polyols, such as glycerol, and mixtures thereof. The lubricant compositions of the present invention may be used in 100 percent active ingredient form, and are also water-dilutable.

DETAILED DESCRIPTION

Figure 1:
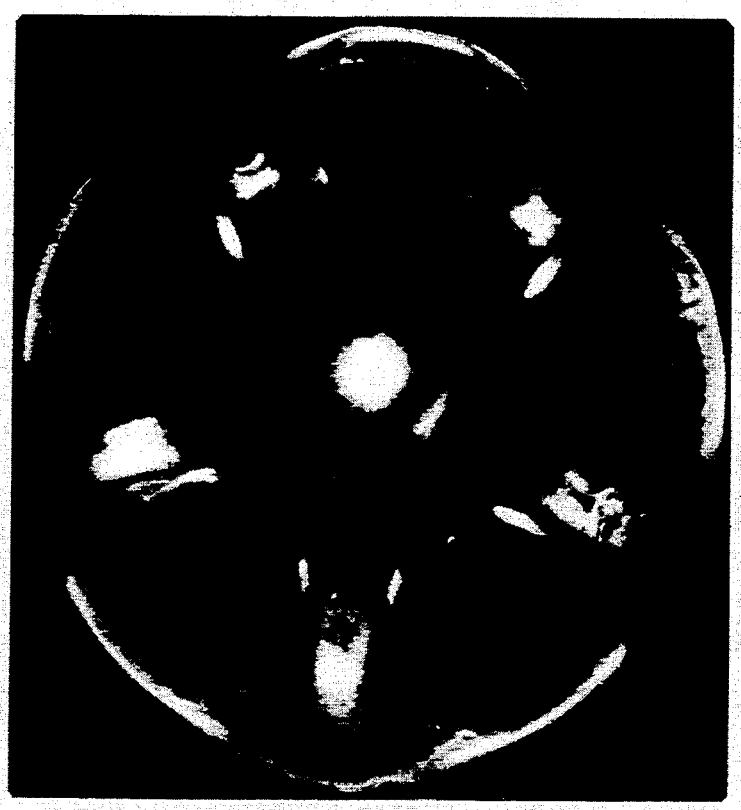
FIG. 1 is a reproduction of a photograph of the bottom of a 2 liter polyethylene terephthalate beverage bottle showing the crazing after contact with a current commercial lubricant for four hours.

The pressurizable thermoplastic materials used in the container construction of the present invention are those which are capable of being blow molded to a rigid structure such that they can withstand being pressurized, typically by carbonation, up to 100 pounds per square inch (psi-gauge) pressure. Preferred materials include crystalline polyolefins such as high density polyethylene and polypropylene, preferably orientable thermoplastic materials which increase in strength when oriented such as by blow molding. Examples of saturated polyesters are polyethylene terephthalate and other thermoplastic materials of the polyester or polyamide type, such as polyhexamethylene adipamide, polycaprolactam, polyhexamethylene sebacamide, poly(ethylene)-2,6-naphthalate, poly(ethylene)-1,5-naphthalate and poly(tetramethylene)-1,2-dioxybenzoate. A most preferred thermoplastic is polyethylene terephthalate.

The containers of the present invention are manufactured by the blow molding process in which a thermoplastic intermediate article is formed by injection molding. After injection molding, the intermediate article is cooled and inserted into a blow mold in which a perforated rod connected to a compressed air source is inserted downwardly into the intermediate article through its neck portion. The assembly is sealed, and the intermediate article is heated while blowing air through the perforated rod to expand the intermediate article to the final shape of the container. After expansion of the intermediate article to the shape of the mold, the mold is then cooled and the article discharged.

The blow molding process is conducted such that the resultant blow molded container has a relatively thick wall construction, typically on the order of 22 to 26 mils (0.56 to 0.66 millimeter), for returnable bottles or a relatively thin wall construction, typically on the order of 12 to 15 mils (0.3 to 0.38 millimeter), for non-returnable bottles. In addition, the base portion of the bottle contains a base enabling the bottle to be free-standing. Typically, the base can be of the so-called champagne base type having a rim portion surrounding an inwardly sloping base portion such as described in U.S. Pat. No. 4,780,257. Alternately, the bottle can be blow molded in such a way that it has a number of protruding feet molded into the base area. Such bottles are well known in the art and are manufactured by Johnson Controls Inc. as BIG FOOT bottles.

The polyurethanes which are useful in coating such bottles are preferably thermosetting polyurethanes such as those based on a polymeric polyol and an organic polyisocyanate including blocked polyisocyanates. Moisture-curable polyurethanes can also be used. Preferred coatings are disclosed in copending U.S. application Ser. No. 07/691,660 filed Apr. 26, 1991, commonly assigned. The coating compositions can be applied by conventional methods including brushing, dipping, flow coating, etc., but preferably are applied by spraying. Usual spray techniques and equipment are used. The coating operation may be conducted either in a single stage or by a multiple stage coating procedure as is well known in the art. Satisfactory results can be obtained with coatings having a dry film thickness of from about 0.2 to 1.5 mils (0.005 to 0.038 millimeter), preferably from about 0.5 to 0.8 mils (0.013 to 0.02 millimeter).

For recycling, the bottles are required to withstand repeated cleaning and refilling. A typical cleaning procedure includes washing of the bottles in 2.5 percent aqueous sodium hydroxide solution containing surfactant heated to about 120° to 140° F. (49° to 60° C.) for 7 minutes. The limiting factor in the usable life of such bottles appears to be stress cracking of the bottle base caused by contact with chain belts treated with current commercial lubricants, which are commonly a blend of fatty acid soap with an ethoxylated fatty acid, and accelerated by the caustic washing.

The present invention provides an improved chain belt lubricant which is a reaction product of a short chain aliphatic alcohol and a short chain alkylene oxide. The alcohol preferably comprises from 2 to 6 carbon atoms and 1 to 6 hydroxyl groups. The alkylene oxide is preferably ethylene oxide, propylene oxide or butylene oxide, most preferably a mixture of ethylene oxide and propylene oxide with a weight ratio ranging from about 10:90 to about 90:10, more preferably about 15:85 to 40:60. The preferred lubricant composition is a blend of two or more alkoxylates based on either a short chain alkanol such as butanol and/or a small polyol such as glycerol, sorbitol or mannitol reacted with an ethylene oxide/propylene oxide mixture having a 25:75 weight ratio. The ratio of ethylene oxide/propylene oxide to alcohol is preferably about 20:1 to 80:1 by weight.

In soak tests, chain lubricants of the present invention do not attack either uncoated polyethylene terephthalate bottles or bottles coated with polyurethane, whereas commercial lubricants soften such coatings. In sliding abrasion tests of both coated and uncoated bottles, the chain lubricants of the present invention result in less scratching and abrasion compared with commercial lubricant. In actual use, the lubricant of the present invention may be applied by any conventional technique such as dripping or spraying onto the processing equipment or the processed articles.

The preferred compositions are aqueous solutions of the alkoxylates having a concentration of about 0.1 to 1.5, preferably about 0.5 to 1.25, percent by weight of the active ingredient. These solutions are compared with commercial chain belt lubricant in pressurized soak tests and sliding abrasion tests. The test cycle comprises 15 minutes at 140° F. (60° C.) in 3.5 percent by weight sodium hydroxide aqueous solution, 3 minutes at 60 PSIG pressure with the bottle ¾ full of cold water, and 4 minutes on a conveyor lubricated with the various solutions with the bottle still ¾ full of cold water. The conveyor is sprayed with a 0.25 weight percent solution of lubricant.

The present invention will be further understood from the descriptions of specific examples which follow.

EXAMPLE I

A precursor composition is prepared by heating butyl alcohol and 0.1 weight percent potassium hydroxide catalyst to 250° F. (121° C.) in a nitrogen atmosphere and adding a mixture of ethylene oxide and propylene oxide. The butyl alcohol is 9.11 parts by weight, and the ethylene oxide and propylene oxide each 6.37 parts by weight. The alcohol and alkylene oxides are reacted for one hour at 250° to 260° F. (121° to 127° C.), then the reaction mixture is cooled to 150° F. (65.6° C.). While maintaining a nitrogen atmosphere and a slight vacuum, the mixture is neutralized and recatalyzed by adding 1 part by weight of a 45% aqueous solution of potassium hydroxide. The above reaction mixture is reheated to 250° F. and a second mixture of ethylene oxide and propylene oxide, 38.53 parts by weight each, is added. The reaction is continued for one hour at 250° to 260° F. Any excess alkylene oxide is removed by vacuum stripping.

A first component is prepared by heating 10.05 parts by weight of the above precursor to 250° F. in a nitrogen atmosphere and adding a mixture of 44 parts by weight ethylene oxide and 45.8 parts by weight propylene oxide. The precursor and alkylene oxides are reacted for one hour at 250° to 270° F. (121° to 132° C.). When the desired viscosity is obtained, the component is vacuum stripped to remove any excess alkylene oxide, cooled to 200° F. (93.3° C.) and neutralized with sulfuric acid (about 0.15 percent) to a pH of 5 to 7.

A second component is prepared by heating 46.6 parts by weight of the above precursor to 250° F. in a nitrogen atmosphere under vacuum. A mixture of 23 parts by weight ethylene oxide and 24 parts by weight propylene oxide is added at 240° to 250° F. (115.6° to 121° C.) and reacted for one hour. The reaction mixture is vacuum stripped to remove excess alkylene oxide.

A lubricant composition is prepared by blending 40 parts by weight of the first component and 10 parts of the second component. The solution has a pH of 4.2 and is diluted and neutralized by adding 2 parts by weight of the solution to 100 parts of an aqueous solution of 4 percent by weight sodium hydroxide.

Coated and uncoated polyethylene terephthalate bottles were subjected to sliding abrasion tests comprising 10 cycles, wherein filled bottles are exposed for 15 minutes at 140° F. (60° C.) in 3.5 weight percent sodium hydroxide solution, 3 minutes at 60 psi air pressure and held stationary while a hardened steel link conveyor belt passes underneath at 55 to 60 feet (15.24 to 18.29 meters) per minute for 4 minutes while the belt is being lubricated with a solution containing 0.25 percent active lubricant composition.

Figure 2:
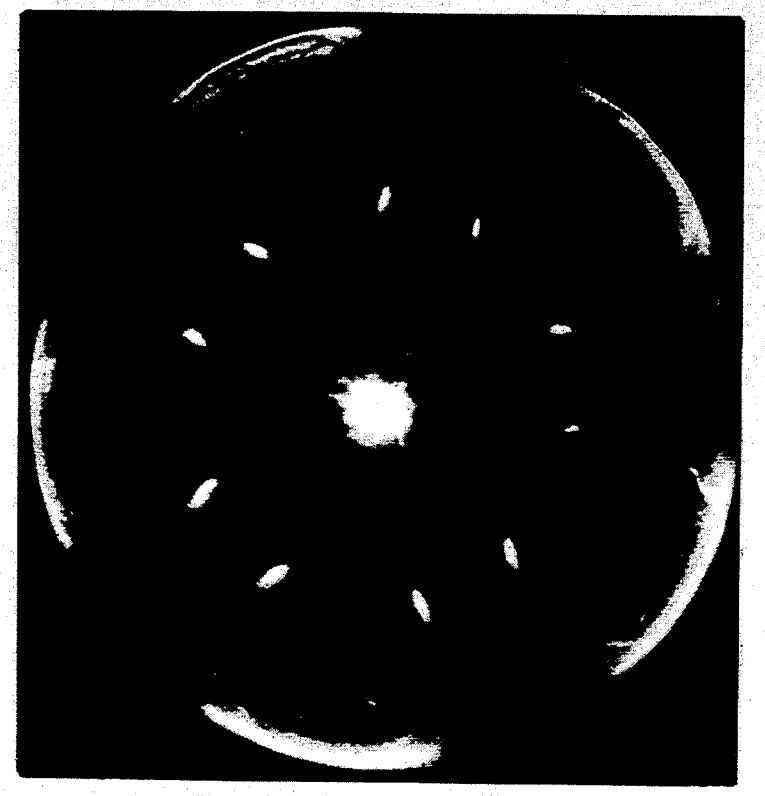
FIG. 2 is a reproduction of a photograph of the bottom of a 2 liter polyethylene terephthalate beverage bottle illustrating the prevention of crazing after contact with a chain belt lubricant composition of the present invention for four hours.

Polyurethane coated bottles show 5 to 10 percent less base area abrasion using the above lubricant composition compared with current commercial lubricant which is fatty alcohol based. Uncoated bottles exhibit less scratching and abrasion with the lubricant of this example compared with current commercial lubricant as shown in FIGS. 1 and 2.

EXAMPLE II

A composition is prepared comprising in percent by weight 10 percent glycerin, 0.8 percent potassium hydroxide and 89.2 percent of a mixture of 25 parts ethylene oxide and 75 parts propylene oxide. The composition is heated to 100° C. and stirred for one hour.

A second composition is prepared comprising in percent by weight 40 percent of the above composition reacted as above with 60 percent of a mixture of 25 parts by weight ethylene oxide and 75 parts by weight propylene oxide.

A lubricant is formulated by combining 160 grams of the first composition and 40 grams of the second composition and diluting with water to a 1 percent solution, which has a pH of 4.4.

EXAMPLE III

A composition is prepared comprising in percent by weight 20 parts glycerin (99.5 percent), 2.2 parts potassium hydroxide (45 percent aqueous solution), 38.9 parts ethylene oxide and 38.9 parts propylene oxide as follows. The glycerin and hydroxide are heated together to 210° to 220° F. (99° to 104.4° C.), then vacuum stripped. In a nitrogen atmosphere, the glycerin is heated to 265° F. (129.4° C.) and the mixture of ethylene oxide and propylene oxide is added at 260° to 290° F. (126.7° to 143.3° C.). The reactants are allowed to react for 1 hour, after which any excess ethylene oxide is stripped off and the reaction product is cooled to 120° F. (49° C.).

The above reaction product is charged to a clean reactor under nitrogen and heated to 280° F. (138° C.) under vacuum. To 9.7 parts by weight of the above is added a mixture of 44.65 parts by weight each of ethylene oxide and propylene oxide at 270° to 300° F. (132° to 149° C.). The reaction proceeds for 1 hour, after Which any excess ethylene oxide is stripped off. The mixture is cooled to 200° F. (93.3° C.) and 0.42 part water is added. After stirring for ½ hour, 0.42 part magnesium silicate is added. After stirring 2 hours at 200° F., the reaction mixture is heated to 250° F. (121° C.), vacuum stripped and cooled to 140° F. (60° C.).

The present invention is illustrated by the above examples. Variations and modifications such as use of other alcohols and polyols, such as ethanol, propanol, butanol, hexanol, sorbitol and mannitol, other ratios and concentrations of reactants and so forth are included within the scope of the present invention which is defined by the following claims.

I claim:

1. A method for reducing abrasion of thermoplastic surfaces by contacting the interface between said surfaces and a conveyor means with a composition comprising the reaction product of a short chain alcohol and a short chain alkylene oxide.

2. A method according to claim 1, wherein said short chain alcohol is an aliphatic alcohol and said short chain alkylene oxide is a mixture of short chain alkylene oxides each alkylene having 2 to 4 carbon atoms.

3. A method according to claim 2, wherein the aliphatic alcohol comprises from 2 to 6 carbon atoms and from 1 to 6 hydroxyl 15 groups.

4. A method according to claim 3, wherein the alcohol is selected from the group consisting of butanol and glycerol.

5. A method according to claim 2, wherein the mixture of short chain alkylene oxides comprises ethylene oxide and propylene oxide.

6. A method according to claim 5, wherein the mixture comprises about 25 parts by weight ethylene oxide and 75 parts by weight propylene oxide.

7. A method according to claim 6 wherein the thermoplastic is polyethylene terephthalate.

8. A method according to claim 7, wherein the polyethylene terephthalate surface is coated with polyurethane.

9. A method according to claim 1, wherein said composition is an aqueous solution of said reaction product.

10. A method according to claim 9, wherein the concentration of reaction product in said solution is from about 0.1 to 1.5 percent.

11. In a method of conveying a thermoplastic container by conveyor means having metallic parts wherein the surface of said container is contacted with the metallic parts of said conveying means and said metallic parts are lubricated with a lubricant, the improvement which comprises reducing abrasion of the container from said metallic parts by using as the lubricant the reaction product of a short chain alcohol and a short chain alkylene oxide.

12. A method according to claim 11 wherein the thermoplastic is polyethylene terephthalate.

13. A method according to claim 12, wherein the polyethylene terephthalate surface is coated with polyurethane.

14. A method according to claim 11, wherein said short chain alcohol is an aliphatic alcohol and said short chain alkylene oxide is a mixture of alkylene oxides each containing from 2 to 4 carbon atoms.

15. A method according to claim 14, wherein the aliphatic alcohol comprises from 2 to 6 carbon atoms and from 1 to 6 hydroxyl groups.

16. A method according to claim 15, wherein the alcohol is selected from the group consisting of butanol and glycerol.

17. A method according to claim 14, wherein the mixture of short chain alkylene oxides comprises ethylene oxide and propylene oxide.

18. A method according to claim 17, wherein the mixture comprises about 25 parts by weight ethylene oxide and 75 parts by weight propylene oxide.

19. A method according to claim 11, wherein said composition is an aqueous solution of said reaction product.

20. A method according to claim 19, wherein the concentration of reaction product in said solution is from about 0.1 to 1.5 percent.

* * * * *

UNITED STATES PATENT AND TRADEMARK OFFICE

CERTIFICATE OF CORRECTION

PATENT NO. : 5,334,322
DATED : August 2, 1994
INVENTOR(S) : William A. Williams, Jr.

It is certified that error appears in the above-indentified patent and that said Letters Patent is hereby corrected as shown below:

Column 6, claim 3, line 3, after "hydroxyl" delete "15".

Signed and Sealed this

Nineteenth Day of March, 1996

Bruce Lehman

BRUCE LEHMAN

*Commissioner of Patents and Trademarks*

*Attest:*

*Attesting Officer*